United States Patent [19]

Hess

[11] Patent Number: 4,638,519

[45] Date of Patent: Jan. 27, 1987

[54] FLUIDIZED HOSPITAL BED

[75] Inventor: Jack H. Hess, Houston, Tex.

[73] Assignee: Air Plus, Inc., Houston, Tex.

[21] Appl. No.: 719,874

[22] Filed: Apr. 4, 1985

[51] Int. Cl.[4] ..... A47C 27/10; A47C 27/08

[52] U.S. Cl. ..... 5/455; 5/453; 5/469

[58] Field of Search ..... 5/449, 453–456, 5/469, 411

[56] References Cited

U.S. PATENT DOCUMENTS

| | | | |
|---|---|---|---|
| 2,715,231 | 8/1955 | Marston | 5/455 |
| 3,116,494 | 1/1964 | Bennett et al. | 5/411 |
| 3,391,009 | 7/1968 | Schild et al. | 5/453 |
| 3,605,138 | 9/1971 | Tucker | 5/456 |
| 3,822,425 | 7/1974 | Scales | 5/456 |
| 3,909,858 | 10/1975 | Ducker | 5/455 |
| 4,525,886 | 7/1985 | Hunt et al. | 5/453 |

FOREIGN PATENT DOCUMENTS

| | | | |
|---|---|---|---|
| 1545806 | 5/1979 | United Kingdom | 5/455 |

*Primary Examiner*—Gary L. Smith
*Assistant Examiner*—Michael F. Trettel

[57] ABSTRACT

Fluidized hospital bed is provided incorporating a segmented, adjustable patient support structure having a plurality of flexible air impervious air bags releasably secured thereto. An air supply is provided for maintaining controllable inflation of selected groups of the air bags with air pressure therein being selectively and automatically adjustable for patient comfort and for emergency patient care. Each of the air bags has a single air inlet in communication with the air supply and multiple air vent holes along the upper side portions thereof or ventilation, patient heating or cooling and removal of moisture. Convex upper surface portions of the air bags facilitate support of the patient without wrapping of air bag material about the patient. The fluidized hospital bed system is powered electrically with both AC and DC current, enabling battery overide in the event of failure of the AC power supply. The power supply system also permits the hospital bed to be disconnected from the AC power supply and transported to other areas of the hospital facility while continuous operation is maintained by the self contained DC supply. Patient support and positioning apparatus enables the bed structure to support patients of virtually any size and weight. A movable footboard and collapsible bed-rail assembly are provided which promote patient comfort and easy access such as for emergency patient care treatment.

14 Claims, 20 Drawing Figures

FIG. 3
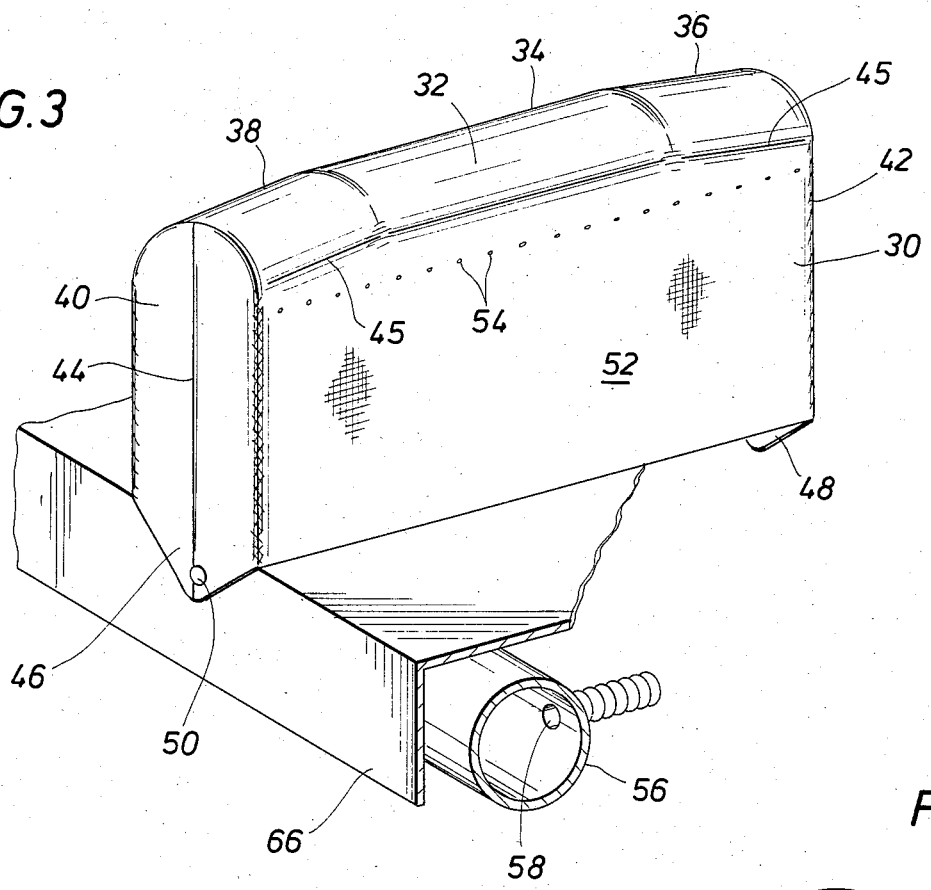
FIG. 4
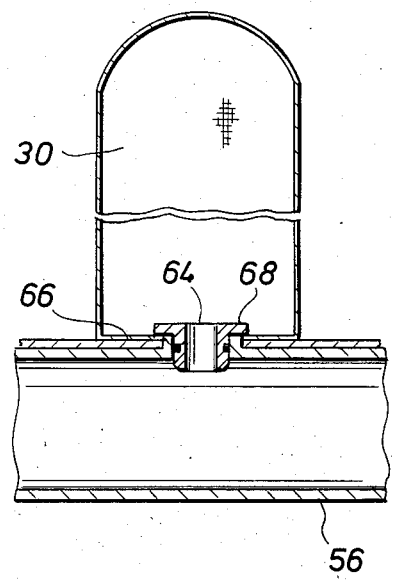
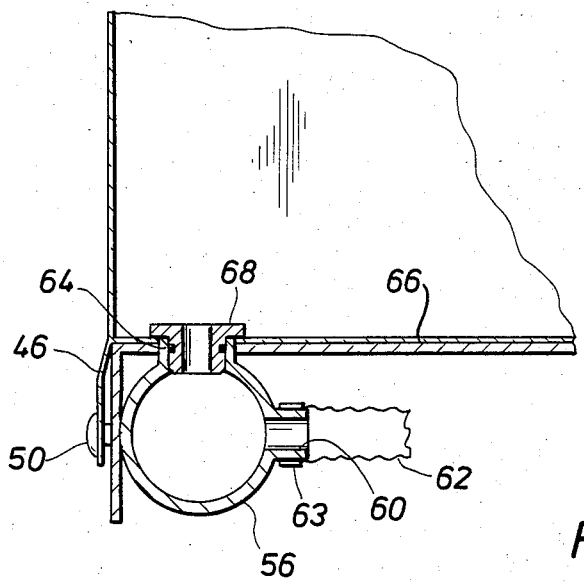
FIG. 5

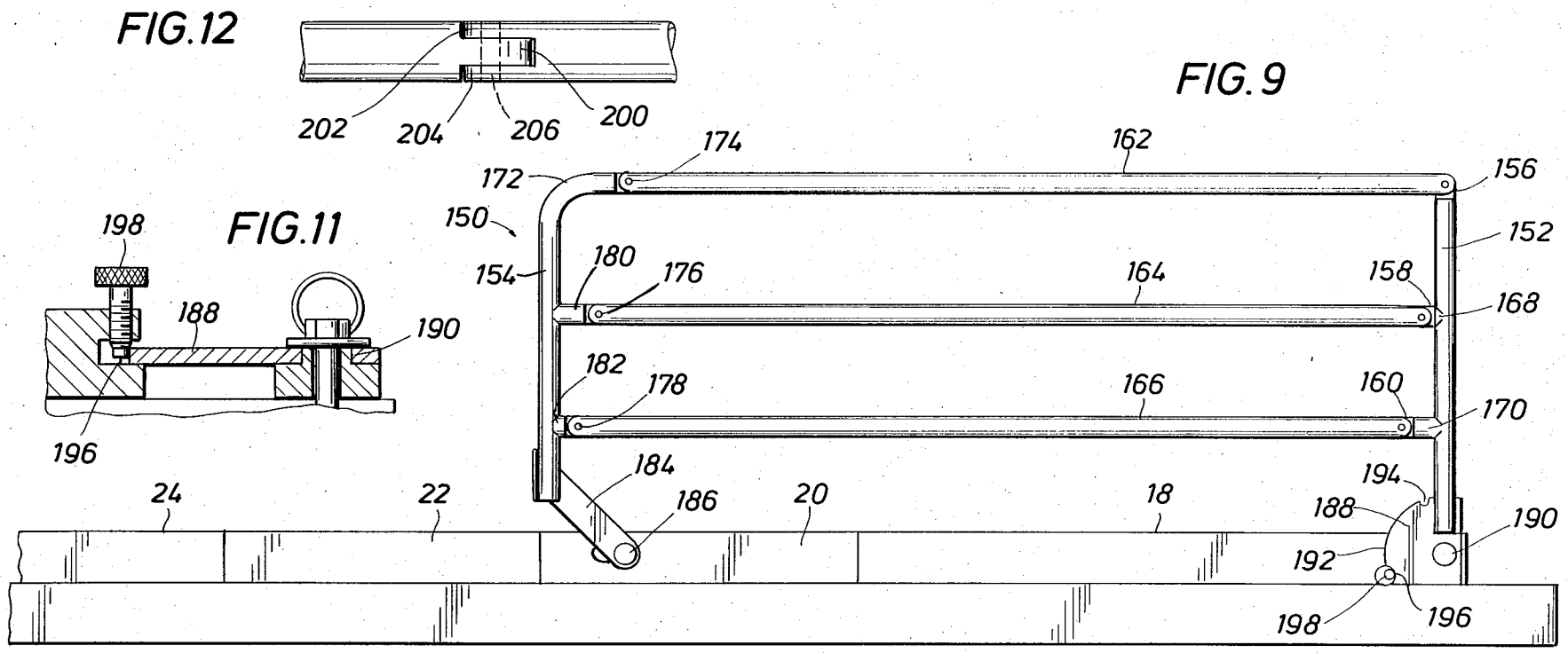
FIG. 9
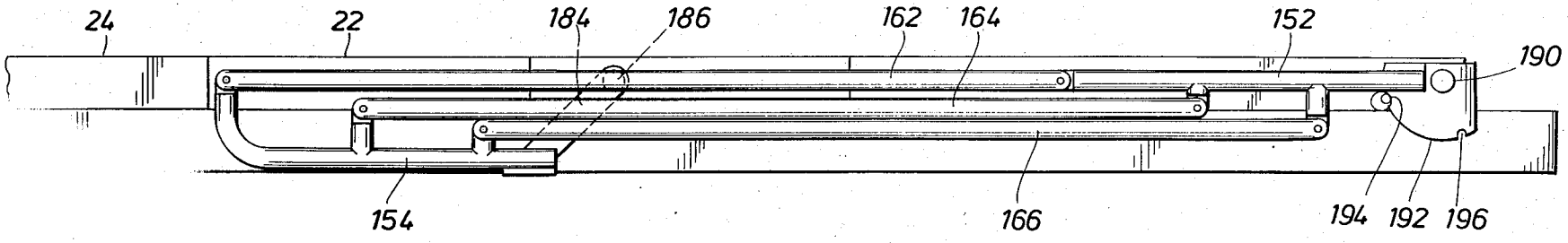
FIG. 10
FIG. 11
FIG. 12

FLUIDIZED HOSPITAL BED

FIELD OF THE INVENTION

This invention relates generally to hospital beds incorporating air bags for patient support and comfort and more specifically concerns an improved fluidized hospital bed for patient comfort, safety and emergency care.

BACKGROUND OF THE INVENTION

For certain character of patient care fluidized hospital beds have been in use for a considerable period of time. For example, during skin grafting procedures and for control of pressure induced lesions or bed sores and the like fluidized hospital beds have been found to provide considerable patient benefit. Beds of this character however have a number of significant drawbacks which in many cases have given hospitals, rest homes and other facilities cause for concern. For example in many cases for patient comfort and safety it is absolutely necessary that the air bag patient support devices remain inflated at all times. In the case of electrical power failure or failure of the air supply, the patient support bags of a fluidized hospital bed can collapse in a short period of time, perhaps causing significant injury to the patient or at least adversively affecting the progress of the patient towards a more healthy condition. It is desirable therefore to provide a fluidized hospital bed system which will remain inflated at all times even under circumstances of electrical utility power failure and in case of mechanical or electrical failure of the air supply system.

Another adverse feature of fluidized hospital beds is the fact that the air bags of the bed are quite soft and the fabric material of the fluidized air bags tends to "wrap around" the patient thus preventing ambient air from reaching a good portion of the patients' body. In this case there is a significant tendency for the patient to perspire heavily in areas where this wrap around effect occurs. Continuous excessive perspiration can maintain excessive moisture present at the patients skin for extended periods of time, thus adversely affecting the comfort and eventual recovery of the patient. This wrap around effect also tends to force the shoulders of the patient toward one another, developing a condition of sunken chestedness which is quite uncomfortable to the patient and causes spinal trauma. It is desirable therefore to provide a fluidized hospital bed system incorporating air bag structures which do not have a patient wrap around effect and thus prevent excessive moisture buildup from perspiration and also prevent sunken chestedness of the patient. Additionally, it is desirable to provide for air flow immediatly beneath the patient to remove moisture and to provide for patient heating and cooling as desired for optimum patient care.

Another drawback of conventional fluidized hospital bed systems arises in the event of emergency conditions, such as cardiac arrest for example. In the event of cardiac arrest it is frequently necessary for nursing personnel to conduct cardiac pulmonary resuscitation (CPR) activities. These activities cannot be conducted effeciently on soft platforms as are typically provided by fluidized hospital bed systems. In this case, the patient must sometimes be moved rapidly to the floor or to a stable platform to enable CPR activities to be conducted. The additional trauma caused by rapid patient transfer is detrimental to the safety and health of the patient. Presently available fluidized bed systems are quite slow to render to a stable platform condition. In one such system the blower must be deenergized and the air supply hose removed from the air supply manifold before the air bags can be rapidly deflated. It is desirable therefore to provide a fluidized hospital bed system which can be selectively controlled by nursing personnel to rapidly deflate the air bags and provide a stable platform for the patient without necessitating removal of the patient from the hospital bed and thereby minimizing trauma to the patient.

THE PRIOR ART

Various aspects of fluidized hospital bed systems are disclosed in the following prior art patents which are generally representative of the state of the art U.S. Pat. Nos. 558,605 and 945,234 disclose early pneumatic beds. U.S. Pat. No. 3,822,425 discloses a fluidized hospital bed wherein air bags are constructed from a material which is gas permeable but is not permeable to liquids and solids. U.S. Pat. No. 3,909,858 discloses a fluidized hospital bed having a unique structure for maintaining a seal between the air bags and the air supply structure provided by the bed. U.S. Pat. No. 4,488,322 discloses a fluidized hospital bed system which relates particularly to the air supply chambers and the inlet and the outlet manifolds which provide groups of airbags with controlled inflation. U.S. Pat. No. 4,099,276 discloses a fluidized bed structure designed for articulation by means of a bellows type power source. Related inventions are disclosed in U.S. Pat. Nos. 2,998,817; 3,303,518; 3,399,407; 3,681,797 and 3,978,530. Various aspects of fluidized hospital bed systems are also disclosed in British Patent Specification Nos. 949,252 of Hamilton; 1,273,342 of Hopkins and 1,474,018 of Hunt et al.

SUMMARY OF THE INVENTION

The present invention concerns an improved fluidized hospital bed system incorporating a bed frame structure having substantially planar segmented patient support plate members which are adjustably positionable such as by electrically driven screw jack mechanisms to provide for various patient positioning and support. The flat plate sections or segments of the patient support plat form structure may be positioned in coplanar relation if desired for patient support, without elevation of the head or knee portions of the patient. In this planar condition, the flat plate-like support portions of the bed structure provide a stable platform such as for emergency CPR activities upon sudden and controlled rather rapid deflation of the multiple air bags providing for patient support and comfort. The air bags are composed of flexible material which is impervious to liquids, solids and air. The air bags which are arranged in patient body related groups and are inflated by an electronically energized air supply system with an appropriate back-up air supply system. The air supply system is communicated with the respective groups of air bags in such manner that each group of air bags is inflated to a desired pressure for adequate support of a particular portion of the patients' anatomy. Apparatus is also provided for adjusting the pressure of the groups of air bags according to the needs and comfort of the patient. For CPR activities and for other such emergencies the air supply system is selectively controllable such that all of the air bags may be deflated within a preselected period of time the patient is thereby quickly lowered to a flat support platform provided by the complanar segmented support portions of the bed structure. Simultaneously, regardless of the relative positions of the segmented sections of the patient support structure, the support structure is automatically rendered to the flat position thereof for these emergency activities.

Each of the air bags of the fluidized hospital bed is provided with a single air inlet maintained in communication with an air distribution manifold connected through a pressure control valve to the air supply system. The air bags each define multiple pin holes along the upper side portions thereof just above the crevices formed by adjacent bags for air distribution to the patient. Through appropriate positioning of the pressure control valves the various air bag groups or sections of the bed may be rendered to proper pressure for effective and efficient patient support and comfort. Considered both transversely and longitudinally, each of the air bags forms a convex upper surface defining a patient support contour forming a central ridge longitudinally of the bed which is approximately of the patients body size. The patient's weight on this central ridge causes the convex portions of the air bags to be forced to an approximately level condition. In such condition the material of the air bags does not tend to "wrap around" body of the patient. Thus, minimal bag contact with the patient's body provides for effective removal of moisture that might adversely influence patient recovery. Sunken chestedness and spinal trauma are also effectively obviated.

The electrical power supply for the hospital bed system functions from AC power from the electrical utility of the hospital. Additionally, battery back-up power is provided to permit bed and patient movement, wherein the DC battery current is rectified to AC for operation of the air supply motors. The battery powered back-up system will maintain the air bags of the bed inflated for a period of approximately two hours which is ample for virtually any character of patient and bed movement such as from room to room in a hospital or between hospital facilities.

When the patient is being shifted from a prone position to a more upright position the weight of the patient becomes concentrated in the pelvic region. In this event, the air supply system automatically increases the pressure in the air bags of the pelvic region to prevent the patient from sagging deeply into the upper surface of the bed. This feature prevents excessive air bag wrap around when the patient is moved to a more sitting position in the bed by articulating the patient support segments of the bed structure.

A collapsible bed rail system is provided enabling nursing personnel to move the bed rails to an out of the way position in only a few seconds time. In the collapsed position, the bed rails permit adequate patient access such as for emergency conditions. The bed rails collapse to a configuration that does not interfere with access to bed positioning controls and air bag pressure controls located beneath the patient support platform.

In the event the patient is of small stature, the footboard structure of the bed incorporates a portion which is selectively movable toward the head portion of the bed, thereby effectivly shortening the bed for patient comfort and control. The movable footboard assembly includes a pivotally mounted footboard which is also capable of being positioned in a substantially horizontal position to serve as a writing platform for use by nursing personnel.

For additional patient support and comfort the fluidized hospital bed structure is provided with a comforter which is removably secured on the combined upper surfaces of the air bags. The comforter is designed for temperature control and for ventilation, allowing air flowing from the air holes of the air bags to circulate through the comforter for patient comfort and for moisture removal. The comforter is of monolithic construction including upper and lower layers of air pervious material between which is located a layer of air pervious thermal insulation such as Bion II R through which air may also pass. The comforter is removably positioned on the air bags by multiple straps that connect it to the support structure of the bed.

BRIEF DESCRIPTION OF THE DRAWINGS

In order that the manner in which the above recited advantages and features of the invention are attained and can be understood in detail, more particular description of the invention, briefly summarized above, may be had by reference to the specific embodiment thereof that is illustrated in the appended drawings, which drawings form a part of this specification. It is to be understood, however, that the appended drawings illustrate only a typical embodiment of this invention and therefore are not to be considered limiting of its scope, for the invention may admit to other equally effective embodiments.

IN THE DRAWINGS

Figure 1:
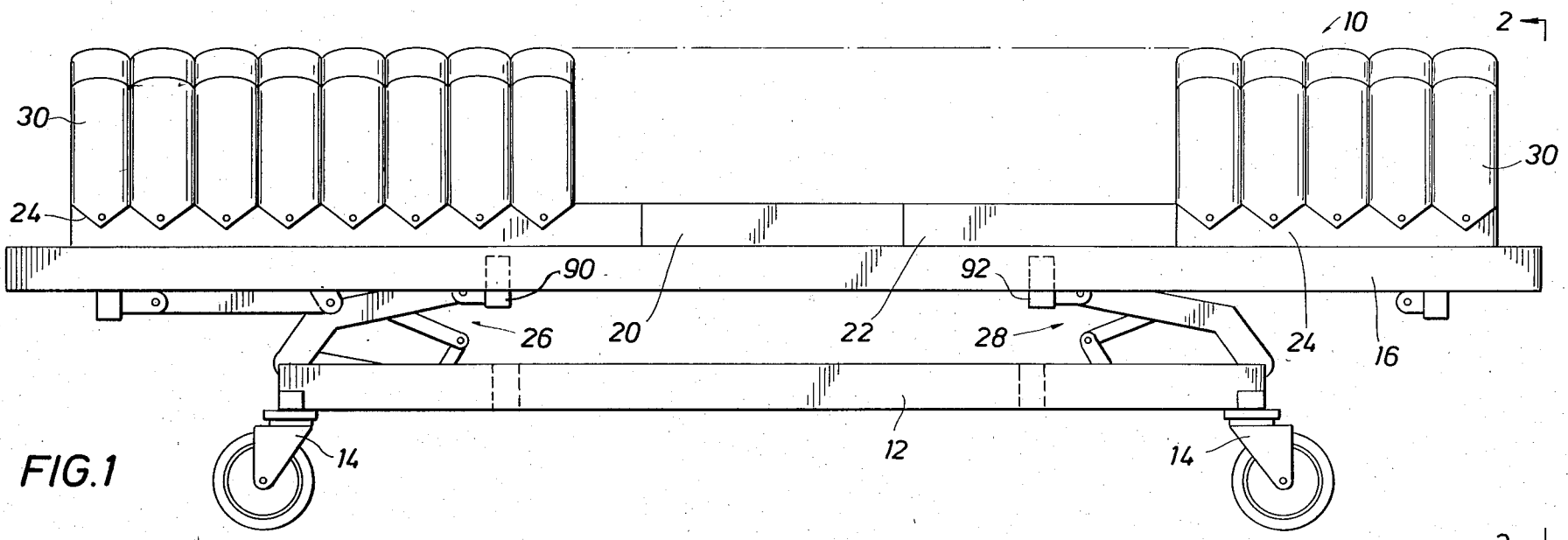
Figure 2:
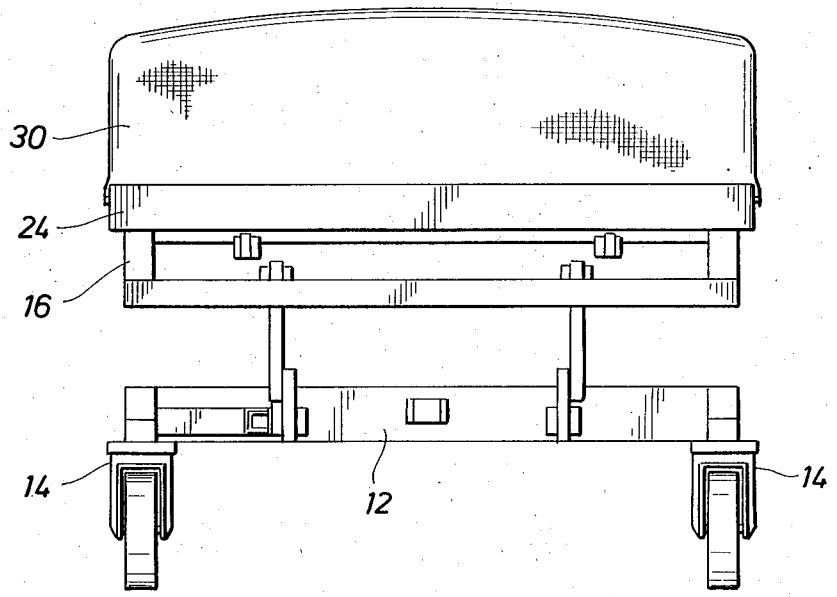
Figure 6:
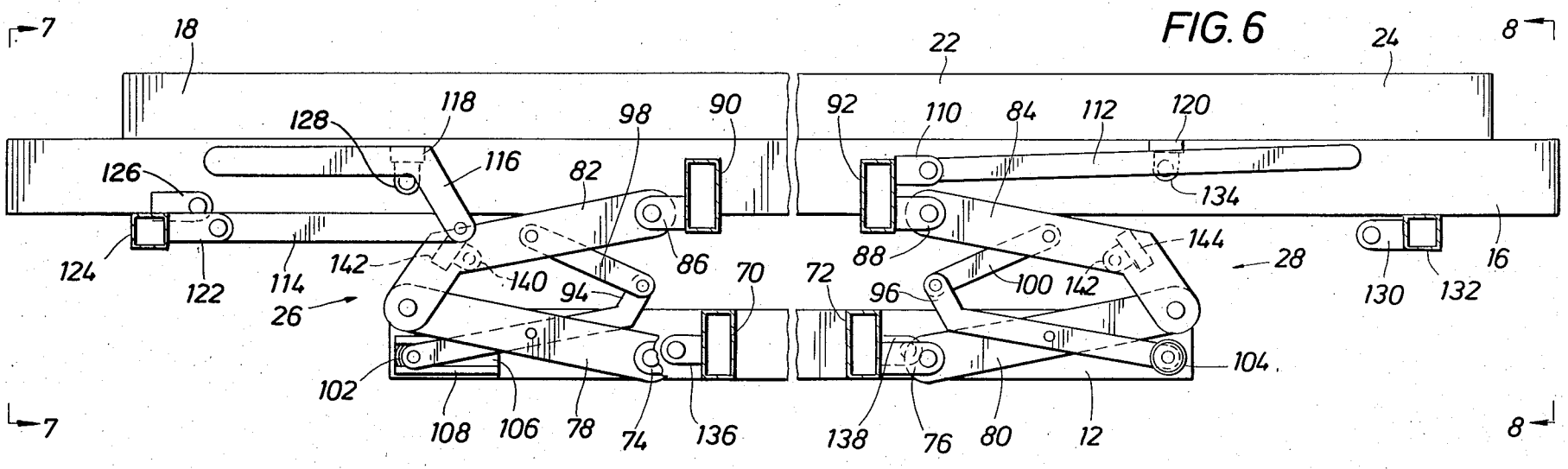
Figure 8:
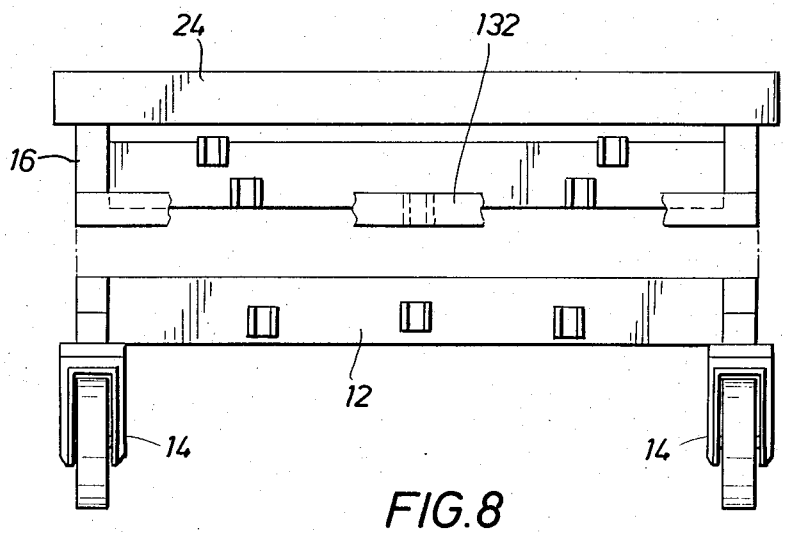
Figure 7:
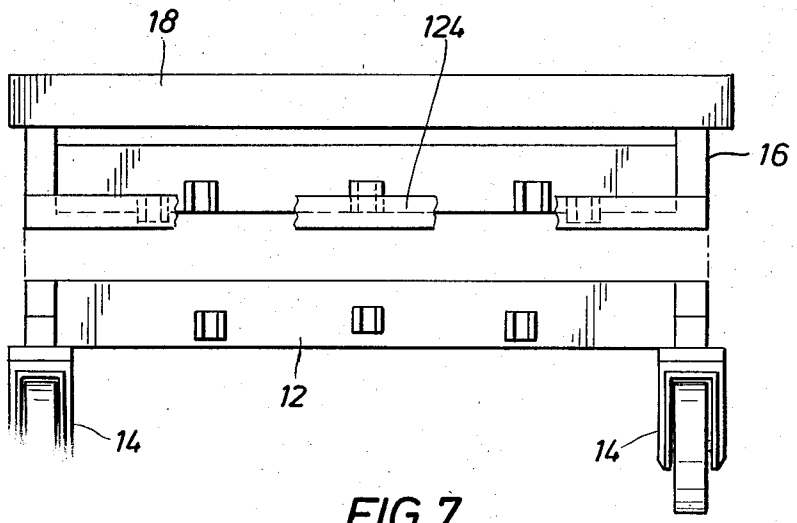
Figure 15:
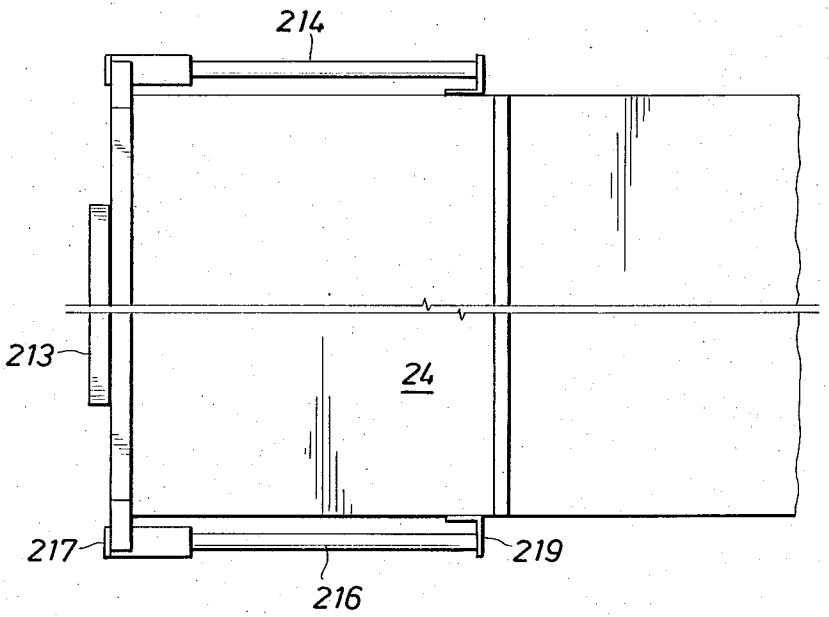
Figure 14:
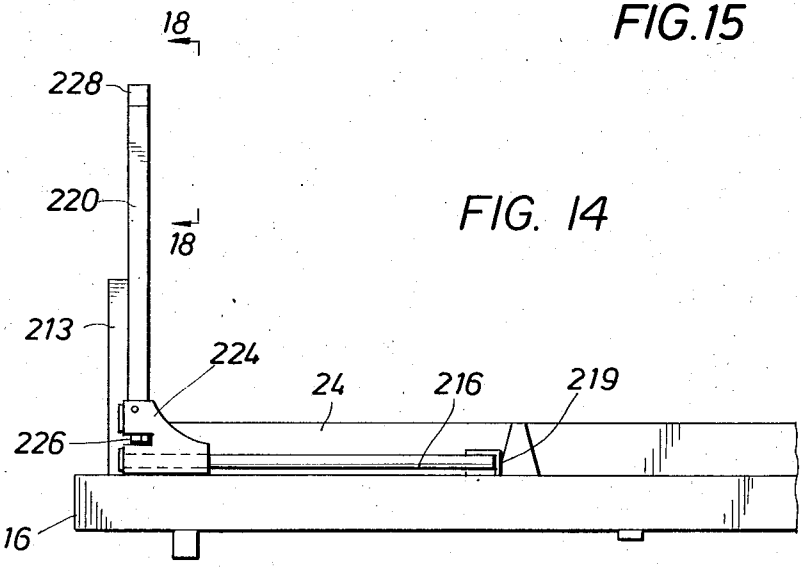
Figure 19:
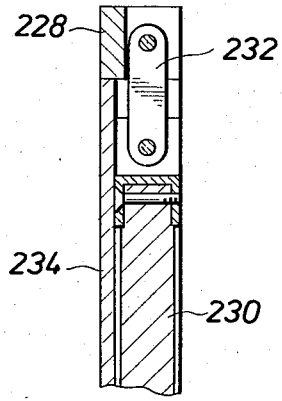
Figure 18:
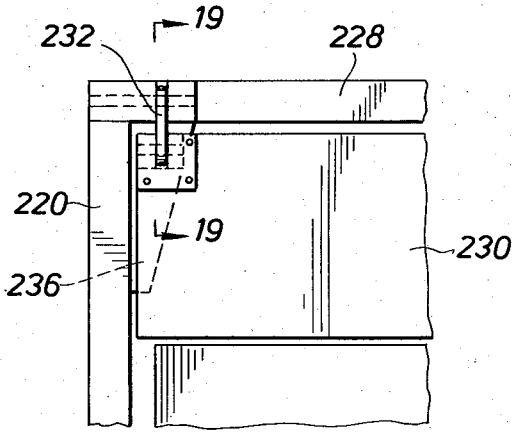
Figure 13:
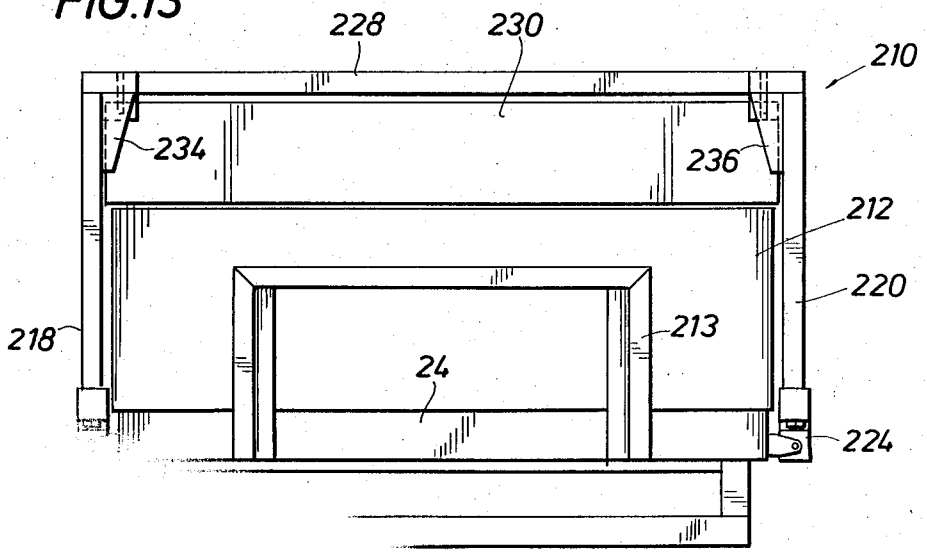
Figure 16:
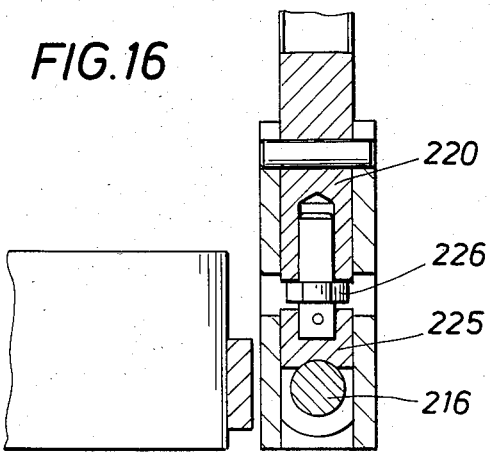
Figure 17:
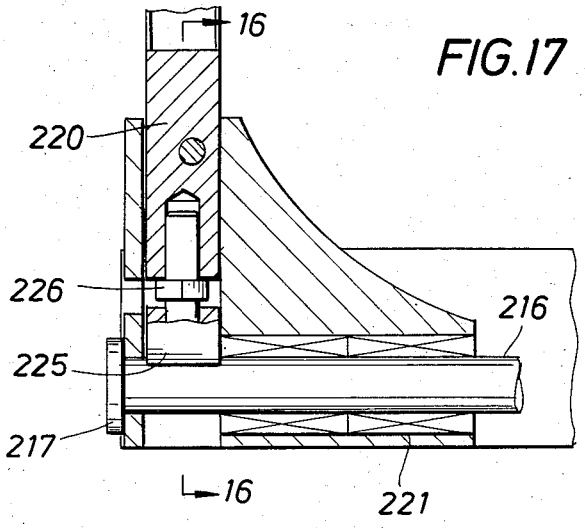
Figure 20:
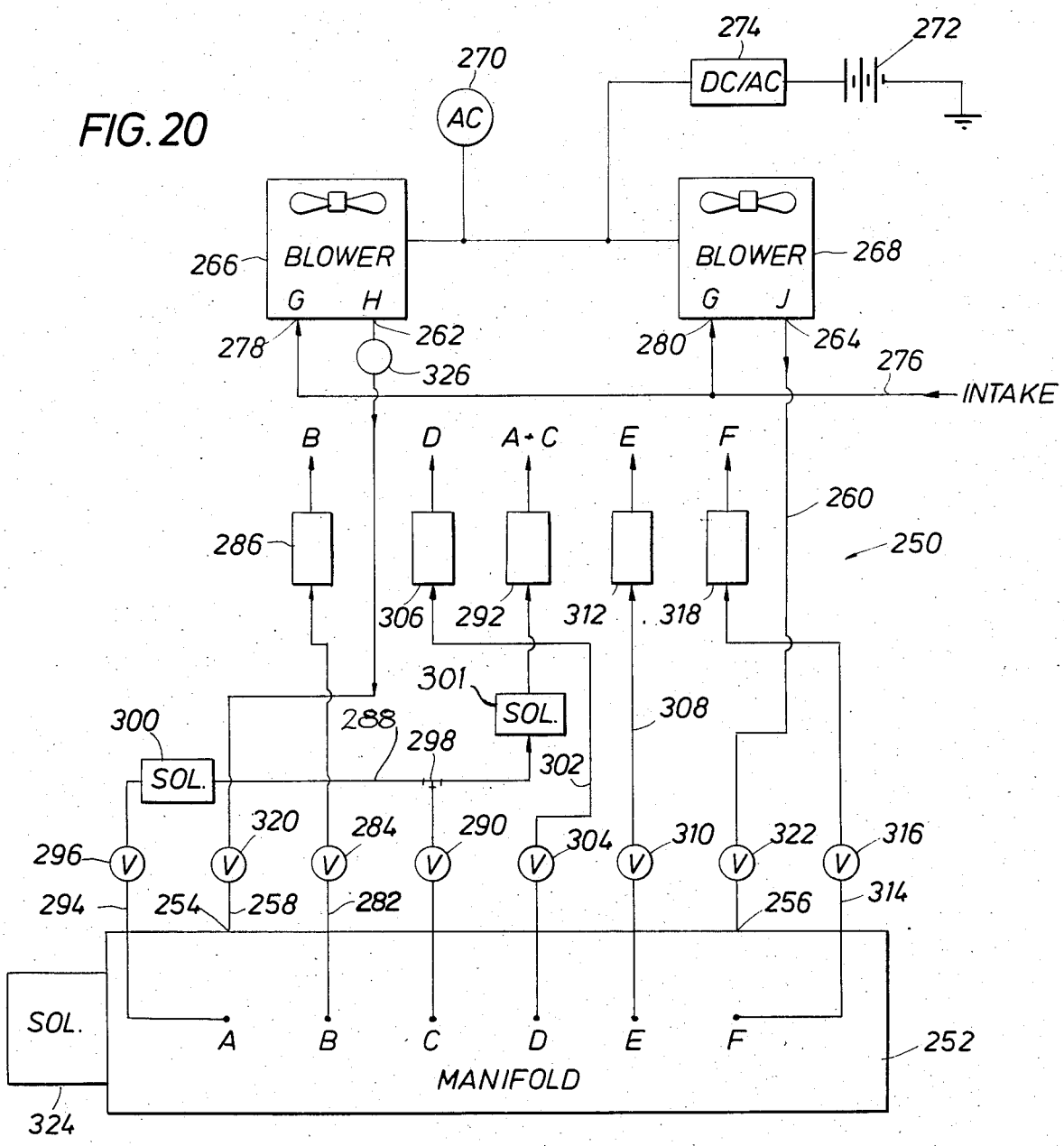

FIG. 1 is a side view of a fluidized hospital bed constructed in accordance with the present invention;

FIG. 2 is an end view of the fluidized hospital bed of FIG. 1 with the head and footboard structures thereof absent to facilitate ready understanding of the invention;

FIG. 3 is an isometric illustration of one of the multiple air bags of the bed structure of FIG. 1;

FIG. 4 is a transverse sectional view of the air bag of FIG. 2A showing its connection with an air supply manifold;

FIG. 5 is a fragmentary sectional view of an air distribution manifold for one of the patient support segments of FIG. 1, illustrating the air inlet connection between the air bag of FIG. 3 with the air distribution manifold;

FIG. 6 is a side view illustrating a bed raising and lowering mechanisms at each extremety of the bed structure of FIG. 1;

FIG. 7 is a fragmentary end view taken along line 7—7 of FIG. 6, having portions thereof broken away to illustrate portions of the undercarriage structure of the bed shown in FIGS. 1 and 6;

FIG. 8 is a fragmentary end view similar to that of FIG. 7 and taken along lines 8—8 of FIG. 6;

FIG. 9 is a partial elevational view of an upper portion of a bed structure, illustrating a movable hand rail mechanism in the upstanding condition thereof;

FIG. 10 is a similar partial side view of the bed mechanism of the hand rail assembly in the collapsed position thereof;

FIG. 11 is a fragmentary sectional view of the hand rail assembly of FIG. 9, illustrating the hand rail lock assembly in detail;

FIG. 12 is a fragmentary sectional view of a hand rail joint illustrating the structural details thereof;

FIG. 13 is an end view of the bed structure of FIG. 1, illustrating a movable footboard assembly together with a fixed footboard assembly;

FIG. 14 is a side view of the bed and movable footboard assembly of FIG. 13;

FIG. 15 is a plan view of an end portion of the bed structure of FIG. 1 showing the movable footboard assembly of FIG. 13, together with the guide rails therefor;

FIG. 16 is a fragmentary sectional view of the movable footboard assembly of FIGS. 13–15 illustrating the structural assembly of the guide rails and footboard;

FIG. 17 is a fragmentary side view in section showing a portion of the movable footboard assembly, taken along line 17—17 of FIG. 16;

FIG. 18 is a fragmentary illustration of an upper corner portion of the movable footboard assembly; FIG. 19 is a sectional view taken along line 19—19 of FIG. 18 and showing the structural details of the pivotal footboard platform assembly; and FIG. 20 is an electrical and pneumatic schematic illustration showing the air supply systems for the fluidized bed system hereof.

DETAILED DESCRIPTION OF PREFERRED EMBODIMENTS

Referring now to the drawings and first to FIGS. 1 and 2, a fluidized hospital bed mechanism is illustrated generally at 10 comprising a lower support frame structure 12 having pivotal wheel assemblies 14 for mobile support of the bed structure. The bed mechanism also includes an upper frame structure 16 providing structural support for a plurality of generally planar patient support segments 18,20,22 and 24. The upper frame 16 is movably connected to the lower frame structure 12 by means of powered toggle linkage mechanisms shown generally at 26 and 28. These toggle mechanisms facilitate raising and lowering of the upper frame member relative to the lower frame and thus properly elevate the bed and patient for proper comfort and medical care.

Each of the patient support segments 18,20,22 and 24 of the bed structure are capable of articulating relative to the adjacement patient support segment to thus permit elevation of the head and knees of the patient or to move the patient from a substantially prone position to a more sitting position as desired for patient comfort. The support segment articulating mechanisms take the form of electrically energized screw jacks of the type also used to provide power for movement of the bed elevation linkages 26 and 28.

For patient support and comfort a plurality of air bags 30, each being substantially identical are secured to respective ones of the patient support segments 18,20,22 and 24 and are disposed in side-by-side, touching relationship. The air bags are each composed of air impervious flexible material such as nylon fabric provided with a heat sealing coating. The material of the bags is also impervious to liquids and solids. As shown in FIGS. 2 and 4 and the isosmetric view of FIG. 3, each of the air bags defines a convex upper surface 32 as viewed both longitudinally and transversely. FIG. 3 shows the convex configuration of the upper surface while the cross-sectional illustration of FIG. 4 shows the convex upper surface transversely. As shown in FIG. 2 the longitudional convex surface of the air bags is defined by a central, almost planar central portion which is of convex configuration, shown transversely; the central portion being of approximately the width of the shoulders and hips of a patient. Extending from the central portion of the upper surface of the air bags are downwardly inclined surface portions 36 and 38 which extend from the central portion 34 to the respective end surfaces of the respective air bags as shown at 40 and 42. During formation of the air bag structure the flexible impervious fabric material is folded over and stitched or secured in any suitable manner along side seams 44 and upper seams 45. The respective end portions 40 and 42 of the air bag structures are extended downwardly to define generally triangular connector portions 46 and 48. Each of these connector portions is provided with a snap connector 50 which is received by an appropriate mating snap connector provided on the respective patient support segment. To provide for air flow from the respective air bags to the upper portion of the patient support bed provided by the multiple air bags, one or both of the side surfaces 52 of each air bag structure is formed to define a plurality of outlet openings 54 which are essentially pin holes formed in the impervious material of the air bag structure. The number and size of the pin holes 54, together with the pressure of the air contained in the air bags determines the distributed air flow from the air bags to the upper surface of the bed. The pin holes are preferably arranged in a horizontally disposed line located a short distance below the upper surface of the air bag and just above the crevice where adjacent air bags come into contact. With the air bags in side-by-side touching relation, air escapes from the pin holes in the region just above the crevice between air bags and flows gently upwardly without impringing directly on the body of the patient.

Each of the patient support segments 18,20,22 and 24 is provided with an air distribution manifold for that particular segment. Also, a primary air supply manifold is provided which takes the form of a tubular member which may be in the form of an elongated cylindrical tubular member as shown in the drawings or any other convenient form within the spirit and scope of this invention. The primary air supply manifold conduit 56 is closed at each end thereof by end walls. The air inlet of each manifold is provided by a single air inlet opening 58 having a connector extension 60 receiving a flexible air supply conduit 62. The air distribution manifold 56 is provided with a plurality of bag inlet connectors 64, one being provided for each of the air bags of that particular patient support segment. As shown in FIG. 4 and 5 each of the bottom surfaces 66 of the air bags defines an inlet opening through which a portion of the inlet connector extends a connector retainer and seal element 68 is positioned in friction tight, air tight sealed relationship within one of the upstanding air inlet connectors 64. The seal is provided by an O-ring member retained within a circumferential groove formed in the retainer element. Thus it is apparent that each of the air bags has a single air inlet opening and no air discharge opening of similar size. Air discharge is achieved only from the sidewall pin-hole openings 54 of the respective air bags which may be on both sides of each of the air bags if desired or, in the alternative, maybe formed in only one side of each air bag. In either case, the position and location of the air outlet openings in the side walls of the air bags serves to locate air discharge from the air bags in the crevices between adjoining air bags and just above the contact area of adjacent air bags. In this manner air discharge is allowed to flow out of each of the air bags at or near the upper portion thereof and to provide an evenly distributed flow of air to the underside of the patient. This facilitates removal of moisture such as might accumulate by perspiration. The air may be heated or cooled as desired to provide for patient comfort and to facilitate the character of medical treatment that is desired.

The convex upper portions of the air bags collectively provide a raised longitudional central ridge for patient support on the fluidized hospital bed. This central, raised ridge is approximately the width of the shoulders and hips of the patient. As the weight of the patient is placed on the fluidized bed the elongated ridge is depressed, and the bed assumes an essentially planar characteristic with the patients body resting thereon. There is no tendency for excessive wrapping of the upper surface portions of the air bags about the body of the patient and no tendency for the air bags to cause constriction of the patient.

Refering now to FIG. 6 of the drawings which illustrates the bed elevational mechasism and the toggle linkages thereof by way of elevational view, the lower frame in structure 12 is shown to be of generally rectangular configuration defining a pair of intermediate transverse members 70 and 72 having main link clevis members 74 and 76 connected thereto. Main link arms 78 and 80 are pivotally connected respectively to main link clevis members and are in turn pivotally connected to angulated main link arms 82 and 84. The opposite extremities of link arms 82 and 84 are pivotally connected to clevis members 86 and 88 extending from transverse structural members 90 and 92 which form structural portions of the upper frame 16. Lower tie arms 94 and 96 are pivotally connected intermediately thereof with the intermediate portions of the lower main link arms 78 and 80. Upper tie arms 98 and 100 are provided having one end thereof pivotally connected to lower tie arms 94 and 96, with the opposite extremeties thereof pivotally connected to the intermediate portions of the upper main link arms 82 and 84. The lower extremities of each lower tie arm 94 and 96 is provided with a cam roller bearings such as the shown at 102 and 104 which are received respectively within undercut cam slots 106 of a roller support track member 108. The roller support track member at the right side portion of the figure is not shown for purpose of simplicity. Second clevis members, one being shown at 110 extends from the transverse structural member 92 and provides for pivotal connection of a link arm member 112 for the foot section of the bed, the foot section being shown at the right hand portion of the figure. At the left hand portion of the figure or the head of the bed a lower link arm is provided at 114 having pivotal connection at one end thereof with an upper link arm member 116. Tie bar members 118 and 120, at the head and foot portions respectively of the upper frame structure, interact with the upper link arms 116 and 12 respectively to cause articulated manipulation of the head and foot portions of the patient support platform provided immediately above the upper frame member. The opposite extremity of lower link arm 114, at the head section of the bed, is pivotally connected to a clevis member 122 extending from transverse structural member 124. Also an actuator clevis member 126 is located at the head portion of the upper frame member and provides for connection of a suitable motorized actuator to the toggle linkage mechanism for raising and lowering the upper frame and bed structure. The motorized actuator, such as an electrically energized screw jack, is pivotally connected to clevis member 126 with the rod end portion thereof connected to clevis 128 extending from the tie bar member 118.

At the opposite or head portion of the bed structure an actuator clevis member 130 is shown to be connected with a transverse structural member 132. A suitable actuator mechanism such as an electrically driven threaded screw jack assembly is connected to the clevis 130 with the rod end portion thereof pivotally received by clevis 134 extending from the transverse tie bar 120 at the foot portion of the bed structure.

FIGS. 7 and 8 are end views of the bed structure, FIG. 7 being from the head end of the bed as shown at the left hand portion of FIG. 6 and FIG. 8 illustrating the right end or foot portion bed structure. Parts of the structure of FIG. 7 and 8 have been broken away to show the various clevises connecting the bed raising and lowering linkages and the head and foot operating linkages which provide for articulation of the patient support segments of the bed structure.

For application of power to the bed raising and lowering linkages 26 and 28 actuator clevis members 136 and 138 extend from transverse structural members 70 and 72. Corresponding actuator members 140 and 142 extend from main linkage tie bars shown in broken lines at 142 and 144. Actuator mechanisms, such as electrically energized screw jacks or other suitable devices, may be connected between the respective pairs of actuator clevises to accomplish power energized manipulation of the mechanical linkages 26 and 28, accomplishing raising or lowering of the upper frame member 16 relative to the lower frame 12.

The hospital bed mechanism is provided with an efficient lightweight hand-rail assembly capable of being simply and easily raised to an upstanding position as shown in FIG. 9 or a collapsed, out of the way position as shown in FIG. 10. As shown in FIG. 9 a head portion of the bed structure is shown at the right hand portion of the figure. A hand-rail assembly is illustrated generally at 150 and incorporates a vertical rail member 152 at the head portion of the bed structure and a vertical rail element 154 at the opposite extremity. Vertical hand-rail element 152 is provided with three pivot connectors 156,158 and 160 each providing pivotal connection for horizontal rail members 162, 164 and 166 respectively. Pivot connector 156 defines a pivot on the center-line of the vertical element 152 while pivot connectors 158 and 160 are offset relative to the vertical element, being provided by pivot extensions 168 and 170.

At the opposite extremity of the bed-rail assembly vertical element 154 defines a 90-degree bend 172 at its upper portion, positioning a pivot connector 174 at a greater offset relation from the vertical element as compared to succeeding pivot connector elements 176 and 178. These pivot elements are supported respectively by pivot extention members 180 and 182.

A connector link 184 is secured to the lower extremity of the vertical element 154 and is connected by pivot member 186 to the fixed patient support section 20 of the patient support platform. The vertical bed-rail element 152 is connected at its lower extremity to a pivotal locking segment 188 pivotally secured to the head segment 18 of the patient platform by means of a pivot element 190. The locking segment 188 defines an arcuate surface 192 having locking indentions 194 and 196 defined therein at approximately 90 degrees angular positions. A locking element 198 is movably positionable for selective engagement with one of the locking indentions 194 or 196, depending upon the position of the bed-rail system. The locking mechanism 198 is manipulated at the position shown in FIG. 9 to release the bed-rail system for lowering to the collapsed position shown in FIG. 10 at which position the lock engages locking resess 194 to thus secure the bed-rail system at the collapsed position thereof. The various related elements of the bed-rail system, when collapsed, position the hortizontal rail members 162, 164 and 166 and closely spaced, hortizonally disposed parallel relation. Also in this position the vertical rail members 152 and 154 are also substantially horizontally disposed. In this condition, the collapsed bed-rail system does not extend below the lower level of the upper frame structure 16 of the fluidized bed system. The collapsed bed-rail therefore does not interfere with access to any of the various controls which are located in the control box supported by the lower frame member 12. Whether the bed-rail system is elevated as in FIG. 6 or collapsed as in FIG. 7, it does not interfere with activities below the level of the upper frame member. When movement of the bed-rail assembly is desired, it is movable between the upright and collapsed positions in a second or two simply upon appropriate release of the latch mechanism 198.

As shwon in FIG. 11 the latch mechanism is illustrated in greater detail and like parts are refered to by like reference numerals.

FIG. 12 is representative of the various pivot connector elements of the bed-rail system. The bed-rails are formed by tubular metal structures composed of lightweight metal such as aluminum alloy for example, which receive respective extremities of the pivot connector therein. One portion of the connector defines the center connector element, such as shown at 200, which is received between pivot elements 202 and 204 and secured relative thereto by means of a suitable pivot pin member 206. To minimize wear and to maintain tight pivot joints, a suitable plastic is interposed in the pivot joints to separate the various metal elements. These plastic members may be composed of any plastic suitable for bearing capability such as polytetrafluoroethylene for example.

It should be born in mind that use of the collapable bed-rail system of FIG. 9 and 10 is not restricted to use with fluidized hospital bed systems. In any hospital situation where it is not desirable to obstruct the area below patient level, the collapsible bed-rail system of this invention will function quite well. It is intended therefore that the collapable bed-rail system disclosed herein be compatable with hospital beds of other character as well.

Referring now to FIGS. 13–18, the fluidized hospital bed of this invention may be provided with a movable footboard assembly which is illustrated generally at 210 and which may be positioned cooperatively with a fixed foot-board structure 212 which is supported by a footboard support 213 on the patient support segment 24 of the patient support platform. On opposite side portions of the patient support segment 24 are secured elongated guide bars 214 and 216, one of which being shown in greater detail in FIGS. 15 and 16. Support elements 217 and 219 position the guide bars in spaced relation with the side surfaces of the patient support segment. The movable footboard assembly is provided with upright support members 218 and 220 having slide bearing receptacles 222 and 224, secured respectively to the lower extremities thereof. As shown in FIG. 16 the bearing slide receptacles incorporate ball bushings 221 establishing smooth bearing engagement with the cylindrical surface of the guide bars. The slide bearing receptacles and bearings of the upright supports receive the guide bars 216 so as to be variously positionable along the length of the guide bars. Appropriate locking devices are employed as shown at 226 in FIG. 16 and 17 which are adapted to secure the slide receptacles 224 and 226 at any suitable position along the length of the respective guide bars. As shown, the locking member 226 is adjustably connected to the slide bearing structure 224 and includes a locking shoe 225 that is tightened to lock the slide in place. Thus the movable foot-board assembly is positionable at any location along the length of the patient support segment 24. Locking and unlocking of the movable footboard assembly is accomplished by simply rotating the threaded locking device 226, causing linear locking or unlocking movement of the friction shoe 225 depending upon the direction of rotation. It is not intended to limit employment of the movable foot-board assembly to fluidized hospital beds, it being within the spirit and scope of this invention to employ the same in conjunction with.

To the vertical footboard members 218 and 220 is connected an upper horizontal structural member 228 which provides for pivotal support of an upper footboard plate member 230. The plate member 230 may be disposed in coplanar relation with the fixed footboard 212 or it may be positioned with the footboard assembly at any location along the length of the guide bar members 214 and 216. The upper footboard plate 230 is pivotally secured to hinge members 232 as shown in FIGS. 18 and 19 which are in turn pivotally connected to the horizontal upper support member 228. The hinge members 232 are arranged to permit the footboard plate member 230 to be pivoted about the upper horizontal structural member 228 to a generally horizontally disposed position. In this position, the board member 230 may function effeciently as a writing platform or a platform for support of equipment used in treatment of the patient. To prevent the footboard member 230 from pivoting in the opposite direction, a pair of generally triangular gusset members 234 and 236 are secured at the juncture of the upright support members 218 and 220 with the horizontal structure member 228.

Referring now to FIG. 20, there is disclosed a schematic illustration of the electrical and pneumatic circuits of the fluidized hospital bed system. At the lower portion of the figure, each of the various air bags of the fluidized bed system is depicted, connection B representing the air supply to the movable head support section. Connection C represents the air supply to the air bags of the fixed pelvic support portion of the bed structure while connection D is representative of the air supply to the air bags of the shoulder portion of the bed structure. Connections E and F show the air supply for the calf and foot air bag sections, respectively. These sections correspond to the articulated patient support segments 18, 20, 22 and 24 shown in FIGS. 1 and 9.

It is desirable to provide the air bags of the various anatomical sections with independent air pressurization and control. As such, the schematic circuitry illustrated generally at 250 incorporates a manifold conduit 252 which may be provided in a form of a length of polyvinyl chloride pipe having closed ends and forming 6 air supply connections which are identified schematically at A through F. These are outlet openings for conducting pressurized air from the manifold 15 to respective groups of air bags. The manifold 252 also defines at least one and preferably a pair of inlet openings shown schematically at 254 and 256 which receive air supply lines 258 and 260 respectively which are in communication with respective discharge ports 262 and 264 of a primary air supply blower 266 and a backup air supply blower 268. Blowers 266 and 268 are energized by electrical energy from a suitable source of alternating current 270 or by electrical energy supplied from a battery source 272 and converted to alternating current by a DC/AC convertor 274. The battery source 272 may provide an auxiliary source of electrical energy such as in the case of electrical power failure but, since most hospitals are provided with auxiliary power sources which become activated immediately upon power failure, an electrical backup source is not particularly needed. The battery source 272 however, is intended for use primarly when the fluidized hospital bed system is to be moved from place to place within the hospital or between hospital facilities.

The blowers 266 and 268 are of extended life variety, ie in the order of 25,000 hours and therefore will provide exceptionally efficient service. In the event, however, the primary blower 266 should fail for any reason whatever, its failure will be sensed electrically thus causing automatic energization of the backup blower 268.

Conduit 276 represents an intake conduit supplying air from the atmosphere to the respective intake ports 278 and 280 of the primary backup blowers. Thus, when either of the blowers is energized the air supply manifold 252 is being provided with a sufficient volumn of air to maintain all of the air bags inflated to the respective desired pressures thereof.

A number of air supply lines are provided which extend from the manifold connections A-F to the various groups of air bags in respective segements of the fluidized hospital bed system. Air supply line 282 extends from manifold connection B to air bag group B, which are the air bags of the head portion of the hospital bed assembly. The pressure of air in the bags of the head portion of the bed system is controlled by positioning of a variable control valve 284. A muffler 286 in the supply line 282 reduces noise of air being supplied to the air bags of group B. In similar fashion, a supply line 288 communicates air at a pressure controlled by variable valve 290 to the air bags of the pelvic region of the fluidized bed system, represented by A and C. This supply line includes a muffler 292. Another supply line 294 having its pressure controlled by valve 296 is in communication with the pelvic region supply line 288 such as by a tee connection at 298. Supply line 294 also includes a solenoid valve 300 which is an electrically energized shut-off valve controlling communication of the supply line 294 with supply line 288.

When a patient is lying substantially prone in bed there is a certain weight in the pelvic region which is transmitted to the air bags of the bed. The variable controlled valve 290 is adjusted to maintain the pelvic region pressure appropriate for a patient lying in the prone position. When the head and torso of the patient are raised and the patient is then more at the sitting position the patients' weight increases significantly in the pelvic region since some of the weight of the head and torso then bear on the pelvic region. To prevent the patient from sinking to deeply in the bed, to prevent the wrap around effect from occuring, and to further insure proper patient comfort in the sitting position, the compressed air from supply line 294 may be at the proper pressure for optimum support of the patient in the sitting position. Therefore, when solenoid valve 300 is energized, communicating supply line 294 with supply line 288, increased air pressure via the setting of valve 296 is communicated to the air bags of the pelvic region of the bed. Moreover, solenoid valve 300 is energized automatically upon raising the head portion of the bed to a certain elevated position so that no adjustment is necessary to insure proper support of the patient either in the prone position or the sitting position. As the bed is then lowered to a more prone position, the solenoid valve 300 is then deenergized or alternately energized to terminate communication of the air supply lines 294 and 288. Pressure of the air bags in the pelvic region will thereafter achieve a pressure equilibrium based upon the setting of control valve 290.

When a patient has convelesced to the point that walking and other exericse can begin the patient is usually permitted to first sit sidewise on the hospital bed perhaps with the feet touching the floor. When air bag type hospital beds are employed such sidewise sitting can be difficult and perhaps even dangerous to the patient because of the instability of the air bag support. Accordingly, the present fluidized hospital bed system permits selective deflation of the air bags in the pelvic region of the bed, lowering the sitting patient to the stable platform afforded by the pelvic section of the patient support platform. When this is done the air bags on either side of the pelvic region, being fully inflated, provide arm-rest type support on either side of the patient. These inflated air bags help stabilize the patient to prevent the patient from falling over sidewise and provide arm rests which permit the patient to use the arms for any desirable shifting of the body or for exercise or stabilization. The solenoid valve 301 is therefore a selectively controllable vent valve which is capable of shutting off the air supply to the air bags of the pelvic region and venting them for controlled deflation. All of the other air bags will remain fully inflated.

The air bags of the shoulder section of bed structure are controlled by air from air supply line 302 under pressure control of valve 304. A muffler 306 is interposed in the line 302 to reduce air noise before its entry into the air bags of section D at the shoulder region of the bed system.

A similar air supply line 308 having its pressure controlled by valve 310 connects with supply E of the manifold 252 and communicates air through muffler 312 to the air bags of bed section E. With supply of compressed air to the air bags of the foot section of the bed system, a supply line 314 is connected to the air supply manifold 252 and is provided with a pressure control valve 316 and an air noise muffler 318.

The individual valves of each of the various sections of the air supply system for the bed are independently set at a desired pressure. In the event all of the air bags are deenergized, restoration of air pressure will automatically bring each of the various bed sections to the preset pressure established by the various control valves. The control valves therefore should be located in an enclosure which is not accessible by general nursing personnel. The air bag support system of the bed structure may therefore be preset by experienced personnel to desired pressures for the particular patient involved. Patients' of all heights, weights, and physical stature may be adequately supported by the fluidized hospital bed system according to the teachings hereof.

The pneumatic supply conduits 258 and 260 are also provided with master control valve 320 and 322 which may be adjusted independently of valves 284, 290, 304, 310 and 316 for simultaneous pressure reduction of the air bags of the various sections B - F. Such pressure adjustment may be temporarily necessary or desirable for particular patient care or therapy, after which the valves 320 or 322 may be fully opened, thereby allowing the air bags of each of the sections to return to their preset pressures as established by the positions of the control valves. The air bags will thus return to their respective preset pressures simply upon opening the master control valves 320 or 322. Valves 320 and 322 may be set to accommodate the weight of the patient. For example, for a 160 pound patient the air pressure required for adequate patient support and comfort is different than that required for a patient weighing 300 pounds. When the bed is used by patients of differing weight the only adjustment necessary is the valve in the line of the operative air supply blower.

In some cases, it is necessary to deflate all of the air bags simultaneously, to thereby lower the patient onto the flat patient support platform defined by the articulted patient support segments of the hospital bed structure. For example, to conduct cardiac pulmonary resusciation (CPR) it is desirable that the patient be located on a stable platform such as would be provided by the patient support segments, with the air bags completely deflated. In some cases, for CPR activities it may be necessary to remove the patient from the bed to a more stable platform. Accordingly, the air supply manifold 252 is provided with a vent valve 324 which is a solenoid energized valve, controllable by a switch in the electrical circuit therefor. The switch will be positioned for ready access by nursing personnel and upon, actuation, the control valve 324 will be moved to a position venting the supply manifold 252. Simultaneously, the switch deenergizes the blower circuit. With the air supply shut down and vent valve 324 open, air from the air bags quickly flows back to the manifold 252 and is vented by selective operation of the solenoid valve 324. In this manner, all of the air bags will be simultaneously deflated in a predetermined period of time, i.e., 5–10 seconds or, so to thus quickly and safely lower the patient onto the stable platform provided by the cooperative patient support segments. Simultaneously with actuation of the solenoid vent valve 324, the electrical circuitry controlling articulated positioning of the patient support segments of the hospital bed will be energized to quickly move the various segments to their horizontal coplanar positions.

The back up blower 268 is electrically connected with the circuitry of the primary blower 266 such that the back up blower will become energized by either the AC or DC/AC power supply upon failure of the primary blower 262. A pressure sensor 326, is communicated with the discharge of the primary blower, provides an immediate electrical signal to the back-up blower circuit upon primary blower failure, causing the back-up blower to be immediately energized. This feature enables a continuous supply of pressurized air to maintain inflation of the fluidized bed system if the primary blower should fail. However, the electric motor powering the blower system 266 and the back up blower 268 are of extended service life variety, i.e. in the order of 25,000 service hours. The likelihood of failure of the primary blower system and the back up blower at the same time is extremely remote.

In view of the foregoing, it is respectfully submitted that the fluidized hospital bed mechanism of the present invention is capable of accomplishing all of the features hereinabove set forth together with other features which are inherent from a description of the apparatus itself. It will be understood that certain combinations and subcombinations are of utility and may be employed without reference to other features and subcombinations. The scope of this invention is intended to be limited only by the scope of the appended claims and is not limited by the specific embodiments shown and described herein.

What is claimed is:

1. A fluidized hospital bed system comprising:

(a) patient support means being adjustably positionable for the comfort of a patient and defining adjustable bed segments;

(b) a plurality of generally identical patient supporting air bags being positioned in side-by-side relation on said patient support means and defining elongated crevices therebetween, said air bags being formed of air and water impervious, water vapor permeable material, said air bags each defining a bottom surface, an upper surface, side surfaces and end surfaces, each of said air bags having a single air inlet opening in said bottom surface and defining elongate air distribution bands located in said crevices, said elongate air distribution bands being located generally along an upper portion of at least one of said side surfaces and being defined by a plurality of small air vent openings disposed along the upper portion of at least one of said side surfaces of said air bags, said small air vent openings being located in spaced relation to establish a condition of continuous evenly distributed air circulation from said air bags along the length of said crevices and immediately beneath the patient; and (c) air supply means being in communication with said air supply opening means of said air bags and being operative to maintain said air bags suitably inflated for patient support and comfort and to compensate for air flow from said small air vent openings into said crevices.

2. A fluidized hospital bed system as recited in claim 1, wherein:

said upper surface of each of said air bags is of convex transverse cross-section and of convex longitudinal cross-section.

3. A fluidized hospital bed system as recited in claim 1, wherein:

said upper surface of each of said air bags is defined by an elongate convex upper central portion and convex side portions contiguous with said convex upper central portion and being inclined downwardly from said elongate convex upper central portion to respective end portions thereof, said convex upper central portions and downwardly inclined surface portions of said air bags cooperate to define patient support surface means of greater height at the central portion thereof than at the side portions thereof to minimize wrapping of air bag material about the patient.

4. A fluidized hospital bead system as recited in 1, wherein:

(a) said air bags define retention tab means at each extremity thereof; and (b) said patient support means includes bag connector means receiving said retention tab means and thus securing said air bags in releasable assembly with said patient support means.

5. A fluidized hospital bed system as recited in claim 4, wherein said air supply means includes:

(a) a plurality of air distribution manifolds located in end to end relation along one of the sides of said patient support means and being associated with respective ones of said bed segments each of said air distribution manifolds forming a plurality of air inlet openings in spaced relation along the upper portion thereof; and (b) flanged air connector means extending through said air supply opening means of respective air bags and forming a passage communicating air from respective air distribution manifolds into respective ones of said air bags, the flange of each of said air connector means securing and sealing the material of said respective one of said air bags with its respective air distribution manifold.

6. A fluidized hospital bed system as recited in claim 1, wherein said air supply means comprises:

(a) a plurality of air inlet manifolds each having a plurality of air bag openings adapted for connection with respective air bags;

(b) a plurality of valved air distribution lines connected to respective ones of said air inlet manifolds, the valves thereof being adjustable to control the air pressure of the air bags of the respective air inlet manifolds;

(c) a single air supply line being in communication with all of said valved air distribution lines; and (d) a source of pressurized air being in supplying communication with said single air supply.

7. A fluidized hospital bed system as recited in claim 6, wherein:

(a) said patient support means is defined by a plurality of substantially flat support segments being adjustably positionable to a coplaner or relatively inclined relation and capable of cooperatively defining a substantially flat support surface on which said air bags are positioned; and (b) means for simultaneously deflating said air bags and lowering the patient onto said substantially flat support surface to accommodate emergency medical treatment of the patient requiring a stable flat patient support surface.

8. A fluidized hospital bed system as recited in claim 6, including:

pelvic pressure control means deflating the air bags supporting the pelvic area of the patient while the other air bags of the hospital bed system remain fully inflated, permitting lowering of a patient in a sidewise seated position with inflated air bags on either side of said pelvic area providing stabilization of the patient in the sidewise seated position.

9. A fluidized hospital bed system as recited in claim 1, wherein said air supply means includes:

air supply pressure adjustment means controlling air supply pressure communicated to said air bags and being selectively positionable for selection of desired air pressure according to the weight of the patient and being adjustable to accommodate the different weight of other patients.

10. A fluidized hospital bed system as recited in claim 9, wherein said air supply means comprises:

(a) air blower means defining an air discharge;

(b) air supply conduit means connected to said air discharge;

(c) air distribution manifold means communicating air to said air bags and being connected to said air supply conduit means;

(d) said air supply pressure adjustment means being a variable pressure control valve capable of being set to air pressure control positions correlated with various weights of patients expected to use said fluidized hospital bed system.

11. A fluidized hospital bed system as recited in claim 1, wherein said air supply means includes:

(a) a primary air supply blower normally disposed in air supplying communication with said air bags;

(b) a back-up air supply blower being selectively disposed in air supplying communication with said air bags;

(c) electrical control circuitry interconnecting said primary and back-up air supply blowers and being operative responsive to sensing failure of said primary air supply blower to energize said back-up air supply blower and deenergize said primary air supply blower.

12. A fluidized hospital bed system as recited in claim 1 wherein said air supply means includes:

(a) alternating current electrical power supply means normally controlling said air supply;

(b) direct current electrical power supply means;

(c) AC/DC converter means converting direct current to alternating current and providing an alternating current output; and (d) means sensing discontinuity of said alternating current electrical power supply means and automatically switching said alternating current output of said AC/DC converter means to controlling relation with said air supply, whereby said air supply means may be disconnected from a source of alternating current for transportation of said fluidized hospital bed system with its operation being maintained by said direct current electrical power supply means.

13. A fluidized hospital bed system comprising:

(a) patient support means being adjustably positionable for the comfort of a patient and defining adjustable bed segments;

(b) a plurality of generally identical patient supporting air bags being positioned in side-by-side relation on said patient support means, said air bags being formed of air and water impervious, water vapor permeable material, said air bags each defining a bottom surface, an upper surface, side surfaces and end surfaces, each of said air bags having air entry opening means in said bottom surface and a plurality of small air vent openings in at least one of an upper portion of said side surfaces of said air bags, said small air vent openings means being located in spaced relation to establish a condition of evenly distributed air circulation from said air bags and immediately beneath the patient;

(c) air supply means being in communication with said air supply opening means of said air bags and being operative to maintain said air bags suitably inflated for patient support and comfort;

(d) a plurality of air inlet manifolds each having a plurality of air bag openings adapted for connection with respective air bags;

(e) a plurality of valved air distribution lines connected to respective ones of said air inlet manifolds, the valves thereof being adjustable to control the air pressure of the air bags of the respective air inlet manifolds; and (f) pressure control means being provided for automatically increasing air pressure in the air bags supporting the pelvic area of the patient responsive to the elevation of the head and torso positions of the patient toward a sitting position, thereby compensating for weight concentration of the patient in the pelvic area, said pressure control means returning air bag pressure to a normal pressure responsive to lowering of the head and torso portions of the patient.

14. A fluidized hospital bed system comprising:

(a) patient support means being adjustably positionable for the comfort of a patient;

(b) a plurality of generally identical patient supporting air bags each being defined by a bottom wall, a top wall, end walls and side walls, said side walls, of adjacent air bags being positioned in side-by-side relation on said patient support means and forming elongated crevices therebetween, said air bags being formed of air impervious material and having air entry opening means in said bottom wall, each of said air bags defining a plurality of small spaced air vent opening means being located in said side walls and being positioned for even distribution of air into the respective one of said crevices to establish a condition of air circulation beneath the patient; and (c) air supply means being in communication with said air supply opening means of said air bags and being operative to maintain said air bags suitably inflated for patient support and comfort, said air supply means comprising:

(1) a plurality of air inlet manifolds each having a plurality of air bag openings adapted for connection with respective air bags;

(2) a plurality of valved air distribution lines connected to respective ones of said air inlet manifolds, the valves thereof being adjustable to control the air pressure of the air bags of the respective air inlet manifolds; and (3) pressure control means being provided for automatically increasing air pressure in the air bags supporting the pelvic area of the patient responsive to the elevation of the head and torso positions of the patient toward a sitting position, thereby compensating for weight concentration of the patient in the hip area, said pressure control means returning air bag pressure to a normal pressure responsive to lowering of the head and torso portions of the patient, said pressure control means comprising;

(i) an exhaust valve disposed in said single air supply line and including electrical control means for moving said exhaust valve from an air supply position to an exhaust position; and (ii) electrical circuit means including switch means operatively interconnected with said exhaust valve and said air supply upon selective actuation of said switch means said exhaust valve being actuated to its exhaust position and said air supply is terminated.

* * * * *